US005797439A

United States Patent [19]

Brandriet

[11] Patent Number: 5,797,439

[45] Date of Patent: Aug. 25, 1998

[54] GOLF BAG COVER AND METHOD FOR USING

[76] Inventor: David S. Brandriet, 1408 Sixth Ave. SE., Watertown, S. Dak. 57201

[21] Appl. No.: 784,358

[22] Filed: Jan. 17, 1997

[51] Int. Cl.[6] ..... A63B 55/00

[52] U.S. Cl. ..... 150/159; 206/315.4; D3/255

[58] Field of Search ..... 150/159, 160; 206/315.4; D3/254, 255

[56] References Cited

U.S. PATENT DOCUMENTS

| | | | |
|---|---|---|---|
| D. 314,863 | 2/1991 | Brengel . | |
| D. 341,485 | 11/1993 | Brengel . | |
| D. 352,167 | 11/1994 | Sheppard, Jr. . | |
| 2,094,186 | 9/1937 | Patrick . | |
| 2,718,251 | 9/1955 | Barbato . | |
| 2,907,364 | 10/1959 | Trenery . | |
| 2,985,212 | 5/1961 | Dozier . | |
| 3,288,189 | 11/1966 | Davis | 150/159 |
| 3,754,587 | 8/1973 | Rainieri | 150/159 |
| 4,234,025 | 11/1980 | Berge . | |
| 4,953,697 | 9/1990 | Stanley . | |
| 4,953,768 | 9/1990 | Muse . | |
| 5,024,259 | 6/1991 | Treadway | 150/159 |
| 5,274,901 | 1/1994 | Sanders . | |
| 5,383,505 | 1/1995 | Cordasco, Jr. . | |
| 5,507,332 | 4/1996 | McKinnon . | |
| 5,690,155 | 11/1997 | Millar | 150/159 |

*Primary Examiner*—Stephen Cronin

*Attorney, Agent, or Firm*—Merchant, Gould, Smith Edell, Welter & Schmidt, P.A.

[57] ABSTRACT

The present invention relates to an article for covering a golf bag. The article includes a rectangular main portion that is integral with a flap portion. The main portion is adapted for covering the body of the golf bag and the flap portion is adapted for covering the top of the golf bag.

15 Claims, 1 Drawing Sheet

GOLF BAG COVER AND METHOD FOR USING

FIELD OF THE INVENTION present invention relates generally to covers for protecting golf bags and golf clubs.

BACKGROUND OF THE INVENTION

In recent years, the sport of golf has become increasingly popular. A significant financial investment is typically required to purchase a set of golf clubs and a suitable golf bag for holding the clubs. Golf bags and golf clubs are commonly exposed to a range of elements such as sun, wind and rain. Consequently, to protect golf bags and golf clubs, numerous covers have been developed. However, such covers have a variety of problems. For example, some covers are too bulky to be readily carried on a golf course. Other covers are difficult and time consuming to place on a golf bag. Still other covers only protect golf clubs within a golf bag, and do not protect the entire golf bag itself. Other covers do not provide ready access to golf clubs within a golf bag. Further covers are configured so as to not allow handles or shoulder straps to project through the covers. Still further covers do not provide ready access to various internal compartments within a golf bag.

SUMMARY OF THE INVENTION

The present invention relates generally to an article for covering a golf bag. The article includes a cover member having a substantially rectangular main portion that is integral with a flap portion. The main portion includes substantially parallel first and second longitudinal edges. A transverse edge positioned opposite from the flap extends between the first and second edges. A first fastening structure extends along the first and second longitudinal edges. The first fastening structure is constructed and arranged to hold the first longitudinal edge adjacent to the second longitudinal edge such that the main portion of the cover member is adapted for surrounding the golf bag and the flap portion is adapted for covering golf clubs within the golf bag.

The present invention also relates to a method for applying the aforementioned article for covering a golf bag. The method includes the step of wrapping the main portion of the cover member around the golf bag. Next, the first and second longitudinal edges of the cover member are aligned in a substantially parallel relationship such that the main portion covers substantially an entire length of the golf bag. The first longitudinal edge is then secured adjacent to the aligned second longitudinal edge such that the main portion of the cover member is secured around the golf bag. Finally, the flap portion of the cover member is pulled over the top of the golf bag to cover the heads of the golf clubs.

The present invention provides a variety of advantages over the prior art. For example, the present invention provides a golf bag cover that allows easy access to clubs within a golf bag. Also, the present invention provides a golf bag cover that can be quickly and easily applied or installed about a golf bag. Furthermore, the present invention provides a golf bag cover that is configured to allow interior pouches of a golf bag to be readily accessed and that allows structures such as golf bag handles or shoulder straps to project through the cover. Golf bag covers constructed in accordance with the principles of the present invention also provide the advantage of being readily foldable into a compact configuration for easy storage within a pouch in a golf bag.

A variety of additional advantages of the invention will be set forth in part in the description which follows, and in part will be obvious from the description, or may be learned by practice of the invention. The advantages of the invention will be realized and attained by means of the elements and combinations particularly pointed out in the claims. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. A brief description of the drawings is as follows.

DETAILED DESCRIPTION OF THE PREFERRED EMBODIMENT

Reference will now be made in detail to exemplary embodiments of the present invention which are illustrated in the accompanying drawings. Wherever possible, the same reference numbers will be used throughout the drawings to refer to the same or like parts.

Figure 1:
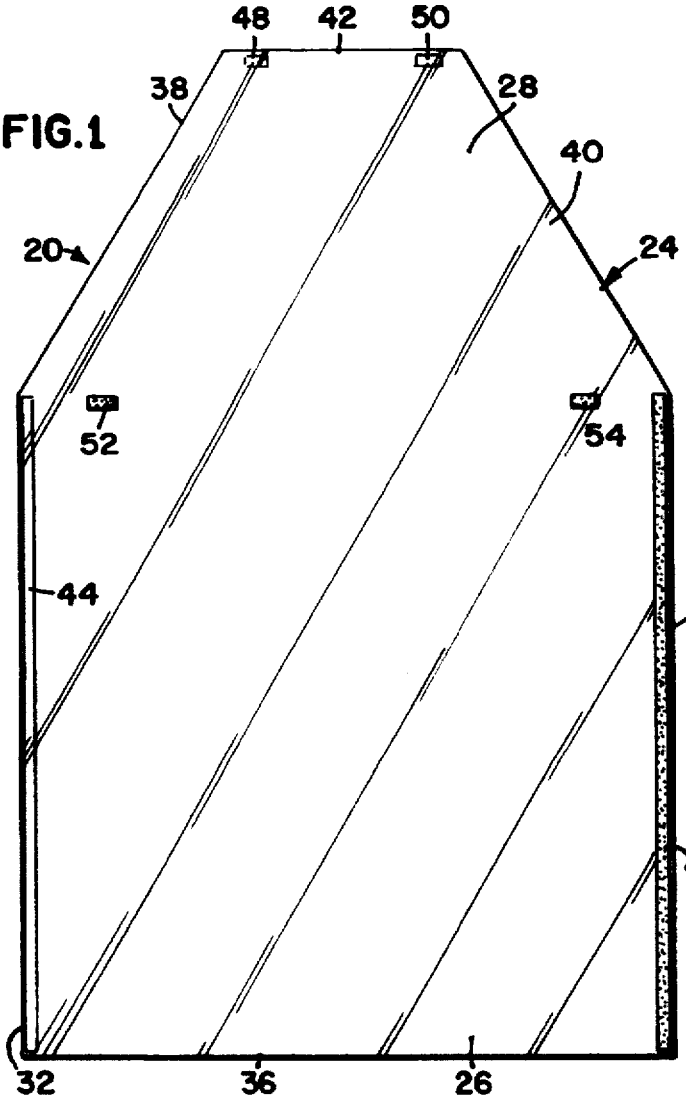
FIG. 1 is a plan view of an exemplary golf bag cover constructed in accordance with the principles of the present invention.
Figure 2:
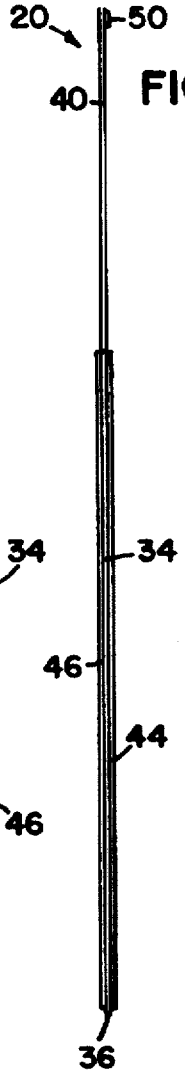
FIG. 2 is a side view of the golf bag cover of FIG. 1.
Figure 3:
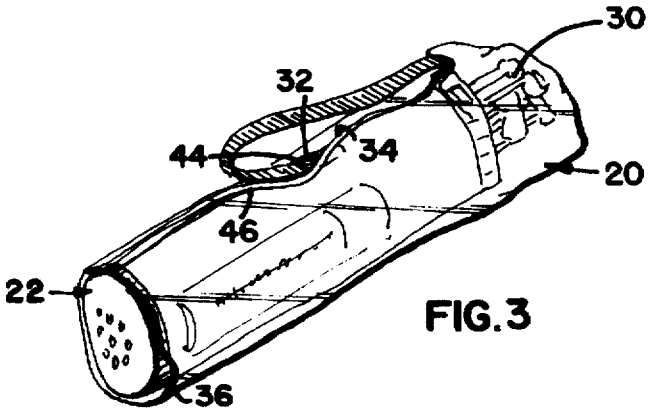
FIG. 3 is a perspective view of the golf bag cover of FIGS. 1 and 2 shown installed on an exemplary golf bag.

FIGS. 1–3 illustrate an exemplary article 20 for covering a golf bag 22. The article 20 includes a cover member 24 including a substantially rectangular main portion 26 that is integral with a flap portion 28. The main portion 26 of the cover member 24 is configured to cover the entire length of the golf bag 22. The flap portion 28 is configured to cover the top of the golf bag 22 such that golf clubs 30 within the golf bag 22 are protected. The elongated main portion 26 provides the advantage of protecting the entire length of the golf bag 22. The flap portion 28 of the cover member 24 provides the advantage of protecting the golf clubs 30 while concurrently allowing the golf clubs 30 to be readily accessed.

As shown in the plan view of FIG. 1, the main portion 26 of the cover member 24 includes substantially parallel first and second longitudinal edges 32 and 34. A transverse edge 36, which is positioned opposite from the flap portion 28, extends between the first and second longitudinal edges 32 and 34. The transverse edge 36 is generally perpendicularly aligned with respect to both the first and second longitudinal edges 32 and 34. It will be appreciated that the transverse edge 36 preferably has a length slightly greater than the perimeter of the golf bag 22. It will also be appreciated that the first and second longitudinal edges 32 and 34 have lengths roughly equal to the length of the golf bag 22.

The flap portion 28 of the cover member 24 includes opposing first and second taper edges 38 and 40 that respectively form oblique angles with respect to the first and second longitudinal edges 32 and 34 of the main portion 26. The taper edges 38 and 40 extend away from the main portion 26 and taper generally toward each other. A distal or outermost edge 42 of the flap portion 28 extends between the taper edges 38 and 40. The outermost edge 42 of the flap portion 28 is substantially parallel to the transverse edge 36 of the main portion 26.

The article 20 also includes first and second longitudinal fastening strips 44 and 46 which function as fastening structures for holding the first longitudinal edge 32 adjacent to the second longitudinal edge 34 when the main portion 26 is wrapped about the golf bag 22. The first longitudinal strip 44 is affixed to a back side of the cover member 24 and is aligned adjacent and generally parallel to the first longitudinal edge 32. The first fastening strip 44 preferably includes a plurality of loops. The second fastening strip 46 is affixed to a front side of the cover member 24 and is adjacent and generally parallel to the second longitudinal edge 34. The second fastening strip 46 preferably includes a plurality of hook structures. It will be appreciated that when the first and second fastening strips 44 and 46 are pressed together, the hooks cooperate with the loops to fasten the strips 44 and 46 together. It will also be appreciated that the first and second fastening strips 44 and 46 are preferably of the type known as "Velcro" fastening strips.

The longitudinal fastening strips 44 and 46 provide a variety of advantages. For example, the fastening strips 44 and 46 allow the main portion 26 of the cover 24 to be rapidly secured about the golf bag 22. Additionally, portions of the fastening strips 44 and 46 can be disconnected from one another to allow structures such as a golf bag shoulder strap or handle to project between the fastening strips 44 and 46 so as to be located on the exterior of the cover. Furthermore, portions of the fastening strips 44 and 46 can be unfastened to allow ready access to pockets within the golf bag.

The article 22 also includes third and fourth fastening strips 48 and 50 aligned generally along the outermost edge 42 of the flap portion 28 and corresponding fifth and sixth fastening strips 52 and 54 located at a top region of the main portion 26 of the cover 24. The fifth and sixth fastening strips 52 and 54 are aligned generally along a line extending transversely across the cover member 24. The third and fourth fastening strips 48 and 50 cooperate with the fifth and sixth fastening strips 52 and 54 to hold the distal region of the flap portion 28 against the main portion 26 of the cover member 24. The fastening strips 48, 50, 52, and 54 are preferably "Velcro" strips and preferably include pluralities of hooks and loops that cooperate to respectively fasten the third and fourth fastening strips 48 and 50 to the fifth and sixth fastening strips 52 and 54.

As shown in FIGS. 1 and 2, the third and fourth fastening strips 48 and 50 are affixed to the back side of the cover member 24 and are located adjacent to the outermost edge 42 of the flap portion 28. Conversely, the fifth and sixth fastening strips 52 and 54 are affixed to the front side of the cover member 24. The fifth and sixth fastening strips 52 and 54 are located along a transverse line extending generally across an upper region of the main portion 26. Additionally, the fifth and sixth fastening strips 52 and 54 are respectively inwardly offset from the first longitudinal edge 32 and the second longitudinal edge 34.

When the main portion 26 of the cover member 24 is wrapped about the golf bag 22 and the first and second fastening strips 44 and 46 are fastened together, the fifth fastening strip 52 is located directly below the third fastening strip 48 and the sixth fastening strip 54 is located directly below the third fastening strip 50. In this manner, when the flap portion 28 is folded over the top of the golf bag 22, the third fastening strip 48 can be fastened to the fifth fastening strip 52 and the fourth fastening strip 50 can be fastened to the sixth fastening strip 54.

In alternative embodiments of the present invention, it will be appreciated that alternative fasteners different from the specific fasteners disclosed with respect to the preferred embodiment may be employed. For example, exemplary alternative fasteners includes ties, buttons, snaps, zippers, and clasps. It will be appreciated that each alternative fastening structure provides different advantages.

In use, the article 20 is preferably stored in a folded configuration so it occupies a minimal amount of space. It will be appreciated that the article 20 can be easily and compactly folded because it preferably essentially comprises a flat sheet. When needed, the article 20 is unfolded such that the cover member 24 assumes a substantially flat configuration. The cover member 24 is then wrapped around the golf bag 22 such that the front surface of the cover member 24 faces away from the golf bag 22 and the back surface of the cover 24 faces toward the golf bag 22. As shown in FIG. 3, when the cover member 24 is wrapped around the cylindrical golf bag 22, the main portion 26 of the cover member 24 forms a generally tubular shape.

To wrap the cover 24 about the golf bag 22, the main portion 26 is pulled around the golf bag 22 such that the first and second longitudinal edges 32 and 34 overlap one another. Once the longitudinal edges 32 and 34 overlap, the second longitudinal fastening strip 46 is brought into alignment with the first longitudinal fastening strip 44 such that the first and second longitudinal edges 32 and 34 are in general parallel alignment. The fastening strips 44 and 46 are then fastened together such that the first longitudinal edge 32 is held generally adjacent to the second longitudinal edge 34 and the main body portion 26 snugly surrounds the exterior of the golf bag 22. In the wrapped configuration, it will be appreciated that the main portion 26 of the cover member 24 covers substantially the entire length of the golf bag 22 such that the entire golf bag is protected from the elements.

Once the main portion 26 of the cover member 24 is secured snugly about the golf bag 22, the flap portion 28 of the cover member 24 is pulled over the top of the golf bag such that the heads of the golf clubs within the bag 22 are covered. It will be appreciated that when the main portion 26 of the cover member 24 is secured snugly about the golf bag 22, the fifth and sixth fastening strips 52 and 54 are located on the exterior of the cover 24 and are respectively positioned directly below the third and fourth fastening strips 48 and 50. Consequently, when the flap portion 28 is pulled over the top of the golf bag 22, the third and fourth fastening strips 48 and 50 are positioned so as to directly face their corresponding fastening strip 52 and 54. By pressing the third and fourth fastening strips 48 and 50 against their corresponding fastening strips 52 and 54, the distal region of the flap portion 28 is secured to the main portion 26 of the cover member 24. Consequently, the fastening strips 48, 50, 52, and 54 prevent the flap portion 28 from inadvertently blowing open such that the clubs are unprotected.

In a preferred embodiment, the cover member 24 is constructed of a transparent material such as transparent plastic so that the clubs can be viewed through the flap 28. The transparent cover also allows internal compartments of the golf bag 22 to be viewed through the main portion 26 thereby facilitating locating such compartments.

With regard to the foregoing description, it is to be understood that changes may be made in detail, especially in matters of the construction materials employed and the shape, size, and arrangement of the parts without departing from the scope of the present invention. It is intended that the specification and depicted embodiment be considered exemplary only, with a true scope and spirit of the invention being indicated by the broad meaning of the following claims.

What is claimed is:

1. An article for covering a golf bag including golf clubs, the golf bag having a top opening through which heads of the golf clubs project, the article comprising:

a cover member including a substantially rectangular main portion integral with a flap portion, the main portion including substantially parallel first and second longitudinal edges and a transverse edge positioned opposite from the flap portion and extending generally transversely between the first and second longitudinal edges; and a first fastening structure constructed and arranged for holding the first longitudinal edge adjacent to the second longitudinal edge such that the main portion of the cover member is adapted for surrounding the golf bag and the flap portion is adapted for covering the heads of the golf clubs.

2. The article of claim 1, wherein the transverse edge of the cover member has a length slightly larger than a perimeter of the golf bag such that the first and second longitudinal edges overlap when the cover member is placed around the golf bag.

3. The article of claim 1, wherein the golf bag has a length, and the main portion of the cover member is arranged and configured to cover substantially the entire length of the golf bag.

4. The article of claim 1, wherein the first fastening structure extends longitudinally along substantially an entire length of the main portion.

5. The article of claim 1, further comprising a second fastening structure for holding a distal edge of the flap portion adjacent to the main portion of the cover member such that the flap portion is adapted for covering the heads of the golf clubs within the golf bag, the second fastening structure extending transversely across the cover member.

6. An article for covering a golf bag including golf clubs, the golf bag having a top opening through which heads of the golf clubs project, the article comprising:

a cover member including a substantially rectangular main portion that is integral with a tapered flap portion, the main portion including substantially parallel first and second longitudinal edges and a first transverse edge positioned opposite from the flap portion and extending between the first and second longitudinal edges, the flap portion of the cover member including first and second taper edges that respectively form oblique angles with respect to the first and second longitudinal edges of the main portion, the flap portion also including an outermost edge extending generally transversely between the first and second taper edges;

a first fastening structure constructed and arranged for holding the first longitudinal edge adjacent to the second longitudinal edge such that the main portion of the cover member is adapted for surrounding the golf bag; and a second fastening structure constructed and arranged for holding the outermost edge of the flap portion adjacent to the main portion of the cover member such that the flap portion is adapted for covering the heads of the golf clubs.

7. The article of claim 6, wherein the cover member comprises a transparent sheet of flexible plastic.

8. The article of claim 6, wherein the golf bag has a bag length, and the main portion of the cover member is arranged and configured to cover substantially the entire bag length of the golf bag.

9. The article of claim 6, wherein the first fastening structure comprises a first fastening strip aligned along the first longitudinal edge of the main portion of the cover member, and a second fastening strip aligned along the second longitudinal edge of the main portion of the cover, the first and second fastening strips cooperating to hold the first and second longitudinal edges together.

10. The article of claim 9, wherein one of the first and second fastening strips includes a plurality of hook structures, and the other of the first and second fastening strips includes a plurality of cooperating loop structures.

11. The article of claim 10, wherein the first fastening strip is located on a front side of the cover member, and the second fastening strip is located on a back side of the cover member.

12. The article of claim 9, wherein the second fastening structure comprises a third fastening strip aligned along the outermost edge of the flap portion, and a fourth fastening strip extending transversely across the main portion of the cover member, the third and fourth fastening strips cooperating to hold the outermost edge of the flap portion near the main portion of the cover member.

13. The article of claim 12 wherein the third fastening strip is located on a back side of the cover member, and the fourth fastening strip is located on a front side of the cover member.

14. A method for covering a golf bag containing golf clubs, the golf bag having a top opening through which heads of the golf clubs project, the method comprising:

providing a substantially flat cover member including a substantially rectangular main portion that is integral with a flap portion, the main portion including substantially parallel first and second longitudinal edges and a first transverse edge extending between the first and second longitudinal edges;

wrapping the main portion of the cover member around the golf bag such that the first and second longitudinal edges overlap;

aligning the first and second longitudinal edges of the cover member in a substantially parallel relationship;

fastening the first longitudinal edge adjacent to the aligned second longitudinal edge such that the main portion is secured around the golf bag; and pulling the flap portion of the cover member over the top opening of the golf bag such that the flap portion covers the heads of the golf clubs.

15. The method of claim 14, further comprising the step of fastening a distal region of the flap portion to he main portion of the cover.

* * * * *